US005140792A

United States Patent [19]

Daw et al.

[11] Patent Number: 5,140,792

[45] Date of Patent: Aug. 25, 1992

[54] MODULAR WALL SYSTEM

[75] Inventors: Terry L. Daw; David F. Procter, both of Salt Lake City, Utah

[73] Assignee: Daw Technologies, Inc., Salt Lake City, Utah

[21] Appl. No.: 550,970

[22] Filed: Jul. 11, 1990

Related U.S. Application Data

[63] Continuation-in-part of Ser. No. 358,876, May 30, 1989, Pat. No. 5,010,702, which is a continuation-in-part of Ser. No. 331,826, Apr. 3, 1989.

[51] Int. Cl.[5] ..... E04B 2/82

[52] U.S. Cl. ..... 52/238.1; 52/241; 52/403

[58] Field of Search ..... 52/238.1, 403, 586, 52/241

[56] References Cited

U.S. PATENT DOCUMENTS

| | | | |
|---|---|---|---|
| 3,423,892 | 1/1969 | Rimington | 52/241 |
| 3,566,559 | 3/1971 | Dickson | 52/126.4 |
| 3,830,027 | 8/1974 | Paisley et al. | 52/241 |
| 4,037,380 | 7/1977 | Pollock | 52/126.4 |
| 4,086,734 | 5/1978 | Hayashi | 52/126.4 |
| 4,103,463 | 8/1978 | Dixon | 52/126.4 |

*Primary Examiner*—Michael Safavi
*Attorney, Agent, or Firm*—Thorpe, North & Western

[57] ABSTRACT

A modular wall system including a plurality of wall panels removably attached between a floor and a ceiling by a head track assembly and a floor track assembly respectively. The wall panels include a core material covered on each face by a thin metal skin and are of sufficient strength and rigidity to allow their placement between the head and floor track assemblies without the requirement of stud members or the like. The head track and the floor track assemblies both comprise gasket elements which prevent the passage of microcontamination around the panel members, and the side surfaces of each panel member contains a gasket which abuts and seals against an adjacent panel member to prevent the flow of microcontaminants around the sides of the panel. The floor track assembly also comprises a fastening member which securely holds the bottom of the wall panel to prevent relative movement therewith. The floor track assembly also includes alignment screws which allow the floor track to be leveled, regardless of the unevenness of the floor it is placed upon, thereby insuring automatic alignment of the well panels when placed thereon and insuring complete sealing between adjacently mounted panels. The floor track assembly can also include a U-shaped cradle which allows for more secure attachment of the floor track assembly to the floor. The present wall system can be used for clean-room construction, or may be used for other types of construction such as office space or the like.

3 Claims, 6 Drawing Sheets

MODULAR WALL SYSTEM

This is a continuation-in-part (CIP-II) of U.S. Pat. application Ser. No. 07/358,876 filed May 30, 1989 now U.S. Pat. No. 5,010,702 entitled "Modular Wall System", which is a continuation in part (CIP-I) of U.S. Pat. application Ser. No. 07/331,826 filed Apr. 3, 1989, still pending, entitled "Floating Connector System Between Ceiling and Wall Structure"

BACKGROUND OF THE INVENTION

1. Field of the Invention

This invention pertains to a modular wall system useful for partitioning off and/or entirely defining sub-units of a larger area. More particularly, the invention relates to a modular wall system wherein the enclosing structure can be assembled or disassembled in components, and wherein the assembled structure can be modified by removal of structural elements without affecting the remaining structure. The invention further pertains to a modular wall system wherein wall panels can be quickly assembled or disassembled, yet wherein the assembled wall system is capable of being sealed at the junctures of each attached wall panel to such a high degree that the wall system may be used as part of a cleanroom structure.

2. Prior Art

The present trend in construction of buildings used for manufacturing, office space, storage, and other business needs, is to build large floor areas having no walls or other means of closing off smaller units of the floor area. This allows the tenant to choose their own floor plan, and to fashion it through the use of modular wall systems. These wall systems include panels which can be fastened in place between the floor and ceiling at nearly any location across the larger floor area, to confine smaller sub-units useful for the purposes of the tenant. Since modular wall panels of this type are not required to carry any load of the building (i.e., are not load bearing walls), they need not remain permanently in their original location and can be removed, rearranged, or replaced depending on changing needs. U.S. Pat. Nos. 3,830,027 and 4,037,380 illustrate a modular construction which offers improved panel members, but does not provide the required sealing features which enable application as a cleanroom.

Prior art structures built for cleanroom use, have in the past been fabricated in accordance with permanent design features, as opposed to temporary or modular construction, because of the high risk and critical impact of microcontamination in certain types of manufacturing, (i.e. the production of integrated circuit chips, electronics components or other products which are subject to contamination in an environment of dust or other microcontamination).

The development of the portable, modular cleanroom enclosure has heretofore been deemed impractical for meeting the stringent requirements of these types of manufacturing environments. For example, the preparation of a multi-layered, integrated computer chip includes fabrication of wafer masks and layouts that include hundreds of tiny circuits whose operational condition depends on the absence of foreign materials. These chips are prepared in an industrial cleanroom which is classified by the maximum amount of contamination allowed in the form of airborne particles. For example, a Class 100 room at 0.05 microns means that a cubic foot of controlled airspace within the cleanroom will have no more than an average total of 100 particles no larger in size than 0.05 microns. Likewise, a Class 10 room means that there are only 10 or less particles of 0.05 microns in size or larger in a cubic foot of airspace.

The trends for increased productivity and chip capacity have increased the need for more stringent standards for cleanroom structures. Movements have developed to reduce the standard for measurement from 0.05 microns to 0.02 microns and to anticipate Class 1 cleanroom conditions. Also, the need to quickly and economically modify the cleanroom structure itself to changing usage requirements is also becoming more and more critical.

Although permanent structures were acceptable for earlier cleanrooms, modern industry demands greater structural adaptability. Many of these demands are not only a natural outgrowth of a changing technology in manufacturing, but also include long standing design problems unique to cleanroom production. For example, manufacturing equipment used within the cleanroom may require day to day maintenance while maintaining the cleanroom environmental requirements. Typically, equipment of this nature is installed as part of a service wall with the operational side of the equipment sealed to the interior of the cleanroom and the maintenance/access side exposed to a service isle exterior of the cleanroom.

Although repair work is facilitated by the service wall configuration, removal of machinery may involve modifications to the wall structure. Therefore, if equipment must be replaced, risk of damage to the cleanroom structure exists. Equally challenging is the need for an adapted wall structure which allows modification in configuration to permit change to new equipment as it is developed. Presently, progressive changes in equipment may require construction of a new cleanroom facility.

U.S. Pat. No. 4,667,579 to Daw shows a cleanroom structure including a plurality of fabricated wall studs removably attached at the junctures of panel elements in such a manner that sealing against particle infiltration is accomplished. This patent includes the use of a conventional steel stud which is slotted to receive a clip, wherein the mated clip is attachable to lateral flanges of abutting panel sections. Although this structure represents a significant improvement over prior art methods for construction of modular wall systems, it must be carefully assembled of the panels and support studs to avoid misalignment which would allow infiltration of dust and the like.

In a case of cleanroom construction, as opposed to other types of wall construction, careful construction techniques have traditionally been required to insure complete sealing of airflow through the wall. It would be a substantial improvement in the art if the structural components, specifically wall panels, were self adjusting to establish coalignment of panel sections within the single plane of panels, including complete sealing of all junctures, without the need or use of studs for supporting and/or fastening the panels.

OBJECTS AND SUMMARY OF THE INVENTION

It is therefore an object of the present invention to provide a modular wall system which is capable of quick assembly.

A further object of the present invention is to provide a wall system wherein wall panel sections are automatically aligned and sealed against adjacent panel sections and against the ceiling and floor.

Another object of the present invention is to provide such a modular wall system wherein panel juncture seals are sufficiently airtight to meet cleanroom specifications.

Still a further object of this invention is to provide a modular wall system in which wall openings used for instrumentation or the like are easily formable and sealable against the instrumentation.

Yet another object of the invention is to provide a modular wall system which requires no wall studs either for connection of adjacent wall panels, or for support thereof.

These and other objects are realized in a modular wall system which can be used for partitioning off and/or for completely isolating an area in a larger room, and which is also adaptable for use as part of a cleanroom structure if desired, wherein the wall system includes a unibody panel section of uniform width which is adapted for interlocking relationship with a floor track assembly mounted upon the floor and a head track assembly mounted to the ceiling of the larger room, and which is also adapted for abutment with adjacent wall panels.

Each panel section includes a honeycombed core sandwiched on each side by a metal skin which forms the exterior surfaces thereof. This metal skin also forms the side surfaces of the panel and is shaped to create a channel along the length of the side surface. A compressible gasket is located in the channel such that it will contact and compress against an identically located gasket on a panel placed directly adjacent thereto, or the exterior surface of a panel placed at a right angle directly adjacent thereto. The top of the panel section has placed therein a generally U-shaped insert which extends along the entire length of the top of the panel section. The bottom of the panel section also contains an insert of generally U-shaped configuration which extends along the entire bottom edge of the panel, and includes a panel clip.

The modular wall systems head track assembly includes a U-shaped head track which is adapted to be attachable to a ceiling, and a head track gasket which seals against the metal skin of the panel section when the panel section is inserted therein. The head track assembly also includes a head track key, located adjacent to the head track gasket, which aids in alignment of the wall panel section when it is being inserted into the U-shaped opening.

The floor track assembly comprises another U-shaped member having a fastening member extending from the central section thereof which when the panel section is in place, mates with the panel clip located in the panel bottom insert. The floor track also comprises gaskets which seal against the panel bottom insert, and a gasket which seals the floor track assembly against the floor itself. When used in cleanroom assembly, the wall system may further include a floor track cradle which is also generally U-shaped in configuration and which is fastened to the floor with the above-described floor track assembly located therein.

The wall panels of the present invention can be adapted to create openings through the wall useful for placement of instrumentation or the like, by removing portions of two adjacent wall panels to create an opening therethrough and then inserting a truss across the wall panels at the newly created opening to securely affix and support the remaining adjacent edges of the two wall panels. The edges of the opening are then covered by bulkhead sections which function to seal against the instrumentation inserted in the opening.

Because of the relatively small number of joints and seams at wall junctions, and because of the sealing gaskets located at each joint and seam, microcontamination is more effectively contained than in the prior art systems. Also, because of the floor track assembly's ability to be leveled along its entire length, wall panels are automatically aligned with adjacent panels, and are much less likely to shift when in place, or to cause slight movements in adjacent wall panels during assembly which would cause openings for microcontamination.

The wall panels in the present wall system may also contain a rack support assembly which comprises a long vertical slot adjacent an edge of the wall panel in the front surface thereof. Support surfaces, sufficiently rigid for attachment of well known types of rack support members, line both sides of the vertical opening.

Additional openings, such as windows or the like may be placed in the wall panels if desired. These openings may be completely enclosed by a single wall panel, or may extend across a plurality of wall panels and be trussed in the manner explained above with respect to instrumentation openings. These window openings may be lined with framing elements in a manner similar to the bulkhead as explained above however, with no means of sealing the opening against instrumentation or the like placed therein. A door configuration is also disclosed which is totally flush with the opposing exterior surfaces of the wall panels.

DETAILED DESCRIPTION OF THE INVENTION

Figure 1:
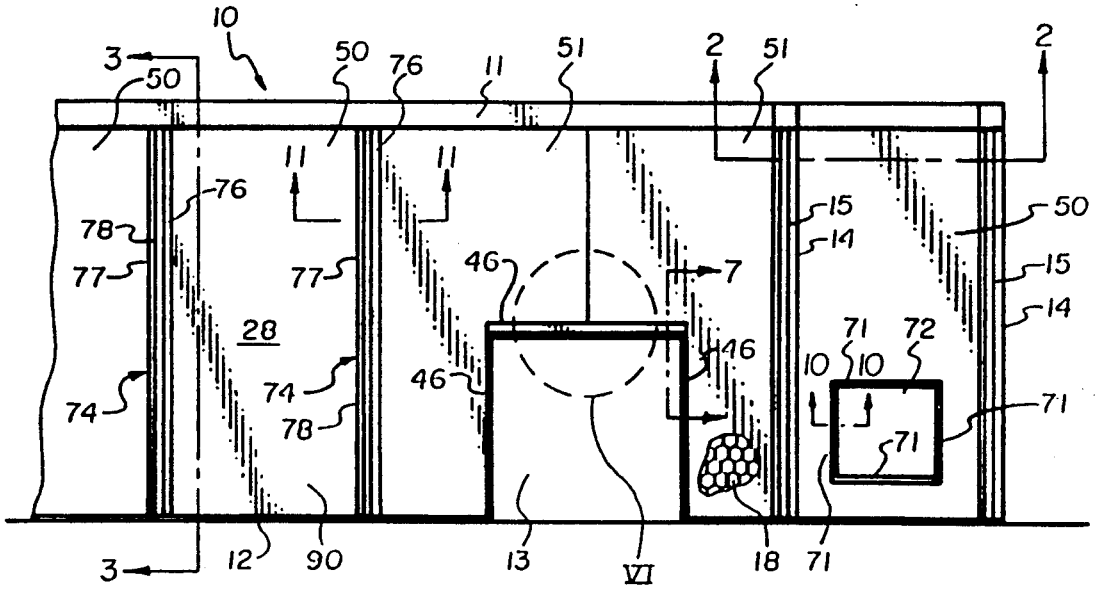
FIG. 1 shows a front view of a section of wall constructed in accordance with the present invention.

Referring now to the drawings in which like features are similarly numbered throughout, FIG. 1 shows a wall system 10 constructed in accordance with the concepts of the present invention including wall panels 50 and 51 placed in edge-abutting relationship, and held in place solely by means of head track assembly 11 and floor track assembly 12. The panels 50 are generally rectangular in shape, and are sized such that they extend substantially the entire distance from the floor to the ceiling of a conventional building, and may be of a thickness of a conventional wall. For example, the panel 50 may be of a height of six to twelve feet, a width of two to six feet, and a depth of one to three inches. In the preferred embodiment of the invention, the height is approximately eight feet, the width is approximately four feet, and the depth is approximately two inches.

The panels 51 have been modified to form equipment opening 13 which allows for mounting of industrial equipment or the like therethrough, with operational access of the equipment being at one side of the wall and maintenance access of the equipment being at the opposite side of the wall. When the wall system 10 is used as part of an industrial cleanroom structure, the equipment opening 13 (or a plurality thereof), may be located in a service wall of the cleanroom. The service wall is generally located proximate to a service isle which is exterior of the cleanroom itself and which allows access to the exterior side of the service wall and the equipment extending therethrough. As has been previously explained, the service wall would provide a location for mounting industrial equipment with operational access to the interior of the cleanroom and maintenance access at the exterior of the service wall in the service isle. A complete explanation of the general idea of mounting equipment through a service wall of a cleanroom is included in U.S. Pat. No. 4,667,579, and such is included herein by reference.

Other openings such as opening 82, may also be placed in panels 50 or 51 in a manner similar to equipment opening 13, as will be explained below. A rack support assembly 74 may also be included in the wall panels 50 or 51. Slot 78, bordered by rack attachment arm 76 and 77 allows for easy insertion and secure retention of well known type rack support members as will be more fully explained below.

Figure 2:
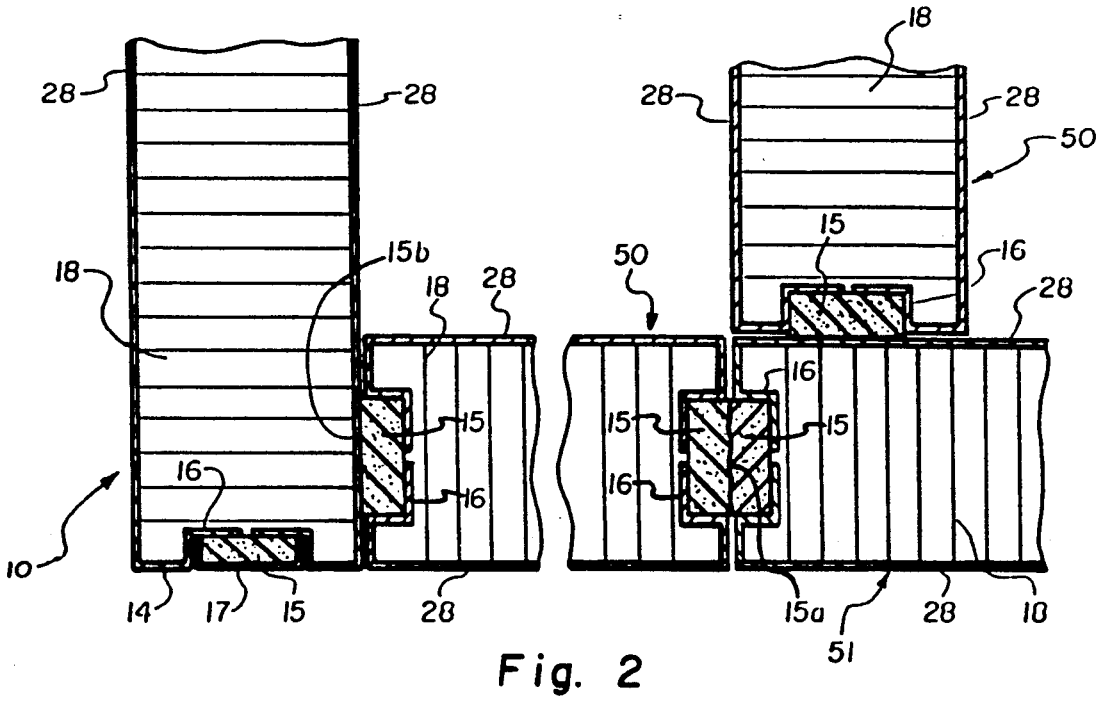
FIG. 2 shows a cross-sectional view of the wall shown in FIG. 1 taken along the line 2—2.

FIG. 2 shows a cross sectional view of a portion of the all system 10 as shown in FIG. 1. Each wall panel 50 and 51 of the wall system 10 comprises a core 18 and two thin skin members 28. The core 18 preferably comprises an extruded aluminum of honeycomb configuration which fills the entire interior volume of the panels 50 and 51. The core 18 functions to rigidify the panels 50 and 51 and to give them sufficient strength to allow them to be used as free-standing members, having no requirement for a stud or the like to hold them in place in the wall system 10, or to provide support or alignment therefore.

The open areas in the honeycombed core 18 may be filled with sound and/or thermal insulating material if desired, or may be left empty. Although the core 18 is disclosed as being a honeycomb shaped aluminum extrusion, it is contemplated that any other core material may be used which can provide the required strength and rigidity, yet remain sufficiently light weight to allow the panels to be easily movable.

Skin members 28 are closed over core 18 and glued thereto in a conventional manner, and extend to form side surfaces 14 and channel 16. Channel 16 is centrally formed in side surface 14, along the entire longitudinal length thereof, and elastomeric and compressible gasket 15 fills the entire length of channel 16. The gasket 15 can be made of any elastomeric material which is capable of sealing against airflow. In the preferred embodiment of the invention, gasket 15 is made of a neoprene tube. At least one gasket 15 extends a short distance above the side surfaces 14 to insure its contact with adjacently placed panels. When a side surface 14 of a panel 50 or 51 is placed in abutting relationship with another panel 50 or 51, the gasket 15 either contacts the adjacent gasket 15 of the adjacent panel 50 or 51, or the gasket 15 contacts the skin 28 of the adjacent panel 50 or 51. If two gaskets 15 meet in abutting relationship, each causes the other to slightly compress, creating an airtight seal **15*a*. When a gasket 15 abuts a skin member of an angularly placed adjacent panel 50 or 51, the gasket 15 is compressed and forms an airtight seal 15*b* with the skin member 28** which does not require interlocking structure between lateral edges of the panels.

Figure 12:
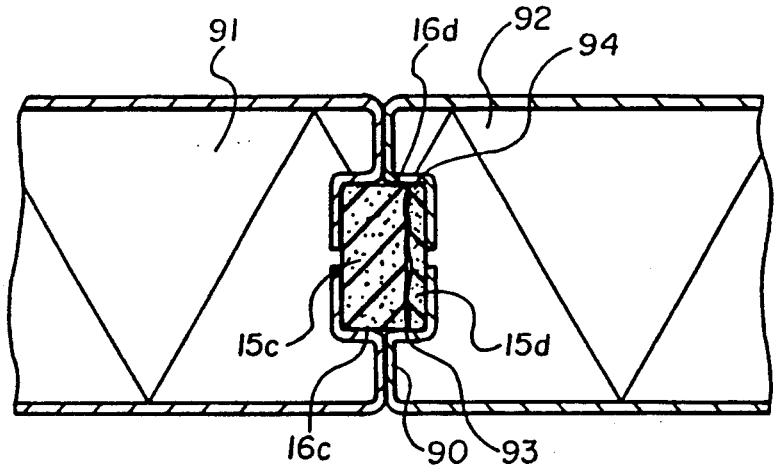
FIG. 12 is a cross-sectional view of an alternate embodiment of a juncture of wall panels as illustrated in FIG. 2.

In a preferred embodiment as shown in FIG. 12, opposing panel sides have gaskets **15*c* and 15*d* which differ in size. For example, the gasket 15*c* on one side of the panel extends beyond the panel edge, while the second gasket 15*d* located at an edge of the panel which will engage the first side is shorter, leaving an exposed channel to receive the first gasket 15*c*. This permits the panels to be interlocked by the engagement of the first gasket 15*c* within the channel containing the second gasket 15*d*. As the panels are forced into position, the extended gasket 15*a* compresses into its channel recess 15*a* as it passes over panel side face 90. When the two panels 91 and 92 are aligned, the gasket 15*c* springs into the opposing channel recess 15*d*, forming an interlocking engagement. The second gasket 15*d* is compressed by the first gasket, forcing the two gaskets to expand against side walls 93 and 94 of the two channels. This construction offers surprisingly enhanced performance in control of dust and improvement of structural integrity of the assembled wall. Nevertheless, removal of the panels is easily accomplished by merely pushing the panel free from the engaged position, forcing the extended gasket 15*c* to compress against the panel face 90** until it is free from the wall assembly.

When the wall system 10 is used to construct a cleanroom, skin member 28 is preferably made of metal such as aluminum or the like, and has a generally smooth surface which prevents entrapment or production of any particulate material which could become airborne. When the wall system is used for other construction purposes, such as storage rooms or office partitions or the like, skin member 28 may be made of polished metal or other decorative material such as plastic, or may be covered with a decorative cloth, or paper, etc.

Cover plate 17 may be placed over gasket 15 whenever the particular design of the wall system causes gasket 15 to fail to abut a portion of an adjacent panel 50 or 51 or is otherwise exposed. Cover 17 prevents damage to gasket 15 and also prevents gasket 15 from collecting and/or dispersing particulates which are capable of becoming airborne. Cover plate 17 may also be made of metal or plastic, and may also be adapted for aesthetic purposes such as have been explained above with respect to skin member 28.

Figure 3:
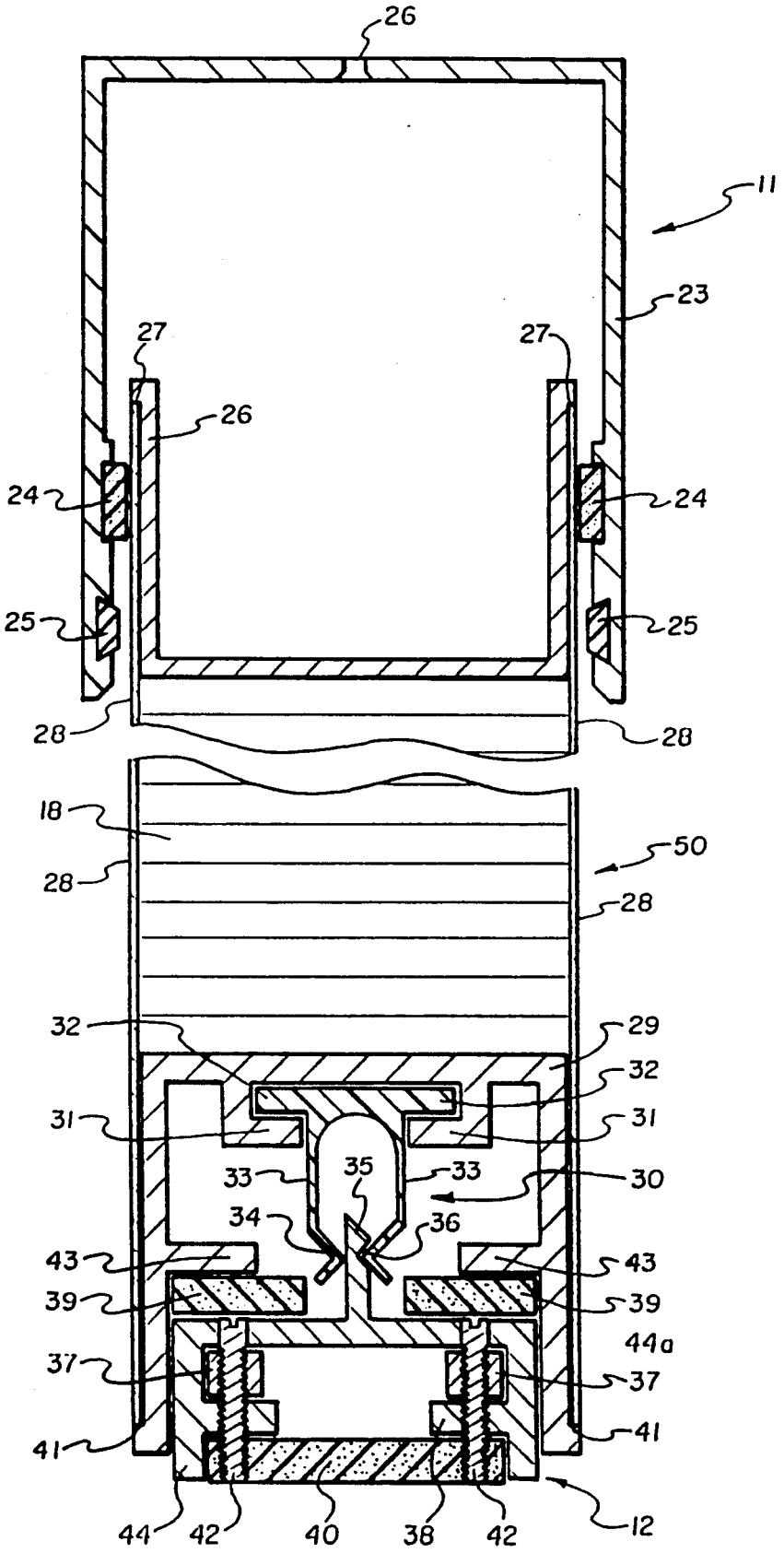
FIG. 3 is a cross-sectional view taken along line 3—3 of FIG. 1.

FIG. 3 shows a cross sectional view of a panel 50 as assembled in head track assembly 11 and floor track assembly 12. The panel 50 includes a panel top insert 26 which is placed along the entire top edge thereof, and includes a lip 27 which meets with the edge of skin member 28 to securely hold the top panel insert 26 in position. The panel 50 also includes a panel bottom insert 29 which is located along the entire length of the bottom edge thereof and also includes a lip 41 which abuts the skin member 28 to hold the panel bottom insert 29 in position. Panel top insert 26 and panel bottom insert 29 are both preferably made of extruded aluminum and secured in place in the panel top and bottom respectively by means of adhesive or the like.

The panel bottom insert 29 further includes clip holding members 31 which define a channel in which the panel clip 30 is retained by means of its retaining shoulders 32. Panel clip 30 also includes clip arms 33 and clip jaws 34. The clip jaws 34 are located such that the fastening member 35, located on the floor track assembly 12, will penetrate the clip jaws 34 and lock in place by means of its locking notch 36, when the panel 50 is placed over and forced down upon the floor track assembly 12. Bottom insert support surfaces 43 are located on the bottom insert 29 at an elevation that will cause the wall panel 50 to rest on floor track assembly 12 when locking notch 36 of fastening member 35 is correctly in place in clip jaws 34. This clip-locked position is important for retention of proper alignment and sealing of panel edges in a cleanroom configuration. It also prevents the panels from sliding along the track assembly.

The floor track assembly 12 comprises a support frame 44, alignment nuts 37 and alignment screws 42. The alignment nuts 37 are held in position by alignment nut support members 38. Alignment screws 42 pass through the alignment nuts 37 and alignment support members 38, and can be adjusted to extend below the bottom of the support frame 44. When an adjustment is made to screws 42, alignment nuts 37 are prevented from rotating by the support frame 44.

After the floor track assembly 12 is placed on the floor, the alignment screws 42 are used to adjust the level of the assembly 12 and support surface to allow compensation for irregularities and non-level areas in the floor. This is necessary to insure that the fastening members 35 remain at a constant elevation (i.e. is level) along the entire length of the support surface of the floor track assembly 12. When the floor track assembly is level, each panel 50 and 51 will automatically square with its adjacent panels when being assembled. Upper and lower floor track gaskets 39 and 40 respectively, function to seal in an airtight manner the connections between the floor track assembly and the floor, and the floor track assembly and the panel 50.

The wall system is constructed by fastening a head track assembly to the ceiling of the building at the location in which the wall is desired. A floor track assembly is then layed across the floor directly below the head track assembly and is adjusted to cause support surface 44a to be completely level across its entire length by means of alignment screws 42. A wall panel is then inserted into the U-shaped frame 23 of the head track assembly 11 with help of the alignment key 25. When the panel is correctly aligned in the U-shaped frame 23, it is pushed upwardly until it contacts with and passes above the gaskets 24. The panel 50 is then pushed further into the head track assembly 11 until the bottom of the panel 50 rises to an elevation slightly above the floor track assembly. The bottom of the panel 50 is then placed directly over the floor track assembly 12 and the panel 50 is allowed to move down onto the floor track assembly 12 until support surfaces 43 rest on the upper floor track gaskets 39. When in this position, a slight force may be necessary to compress upper floor track gaskets 39 sufficiently to allow fastening member 35 to penetrate the clip jaws 34 a sufficient distance to allow them to be locked in place by locking notch 36. Subsequent panels 50 or 51 can then be locked in place by friction action of support surface and clip in abutting relationship along the desired length of the head and floor track assemblies without further concern for correct alignment of the side surfaces 14 and/or gaskets 15.

Figure 13:
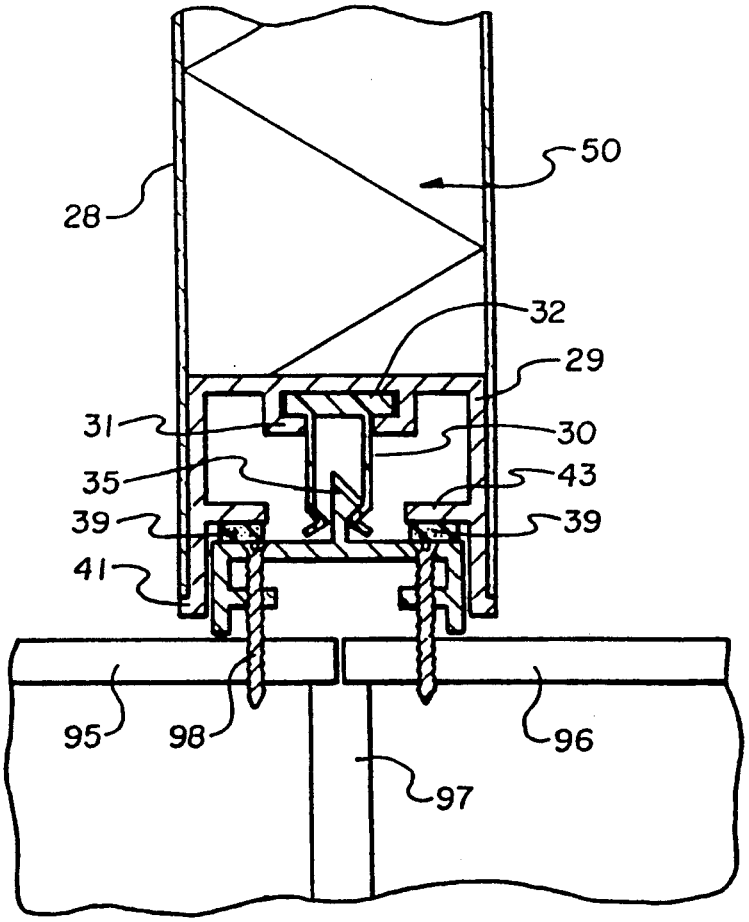
FIG. 13 is a cross-sectional view of an alternate embodiment of a floor track and clip attachment structure as shown in the lower half of FIG. 3.

FIG. 13 illustrates a further embodiment of a floor track that does not require separate leveling. In this instance, the floor structure 95 and 96, with support pedestal 97, would be properly leveled and then the track which mounts to the floor surface would likewise be level. Screws 98 are used to secure the track to the floor structure 95 and 96. Fastening member 35 secures the wall 50 in place by engaging the clip 30.

Figure 4:
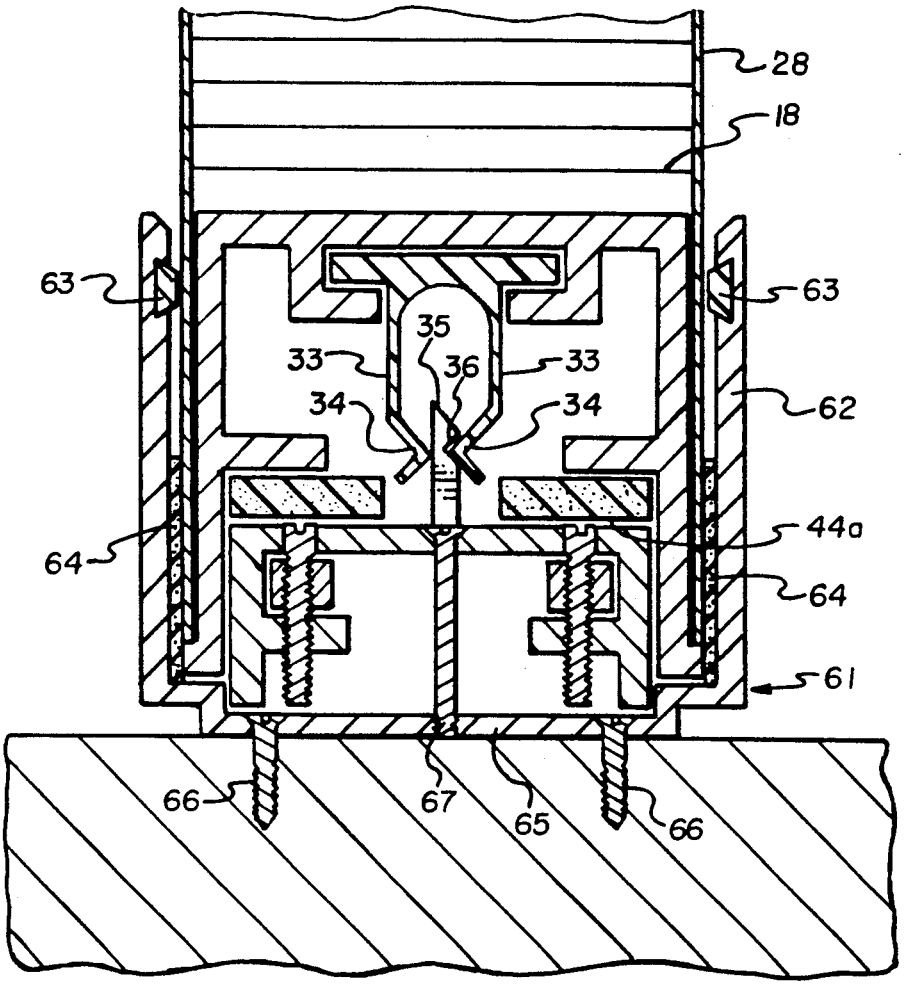
FIG. 4 is a cross-sectional view of an alternative embodiment of the floor assembly.

When using the modular wall system 10 for cleanroom structures, or other purposes which require the floor track assembly 12 to be very securely fastened to the floor, floor track cradle 61 may be fastened to the floor at the desired location and floor track assembly 12 may be located directly therein. As best seen in FIG. 4, a floor track cradle 61 comprises a frame 62 of generally U-shaped configuration having a base portion 65 through which screws 66 may be driven for secure attachment to the floor. Floor track assembly 12 is then leveled inside cradle 61 by means of alignment screws 42 as explained above. Once floor track assembly 12 has been leveled along its entire length, screw 67 is securely fastened into the cradle base portion 65 thus rigidly securing the floor track assembly 12 in its preset location and elevation.

Upper floor track gaskets 39 are then placed on the floor track assembly 12 and the wall panel 50 is then placed in position substantially in the same manner as described above. Lower floor track gasket 40, as seen in FIG. 3, is no longer required when cradle 60 is used. Instead, gaskets 64, located in the cradle 61, function to seal the bottom edge of the wall panel 50, thereby preventing airflow around the bottom thereof. Alignment keys 63 in cradle 61 function to aid in alignment of the wall panel 50 when it is being placed inside the cradle, much in the same manner as head track assembly alignment keys 25. The cradle is preferably made of a plastic or extruded metal such as aluminum.

Figure 5:
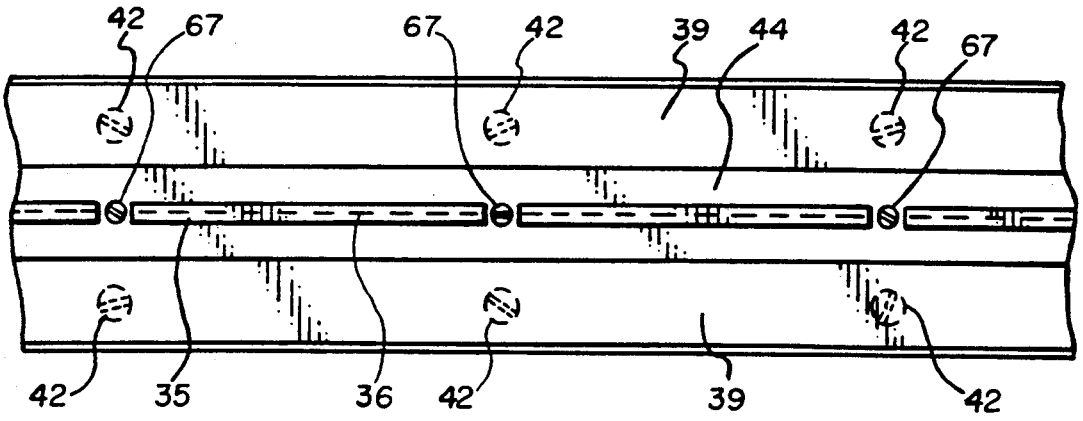
FIG. 5 is a top view of the floor track of FIG. 4.

FIG. 5 shows the floor track assembly of FIG. 4 with the upper floor track gaskets 39 in place thereon. Fastening member 35 is shown to be substantially continuous along the entire length of the floor track assembly 12, allowing for gaps therein sufficiently large to allow fastening screw 67 to be placed through the frame 44. However, fastening member 35 need not be continuous along the floor track assembly 12, nor need the panel clip 30, as seen in FIG. 4, be continuous along the entire bottom portion of panel 50.

Figure 6:
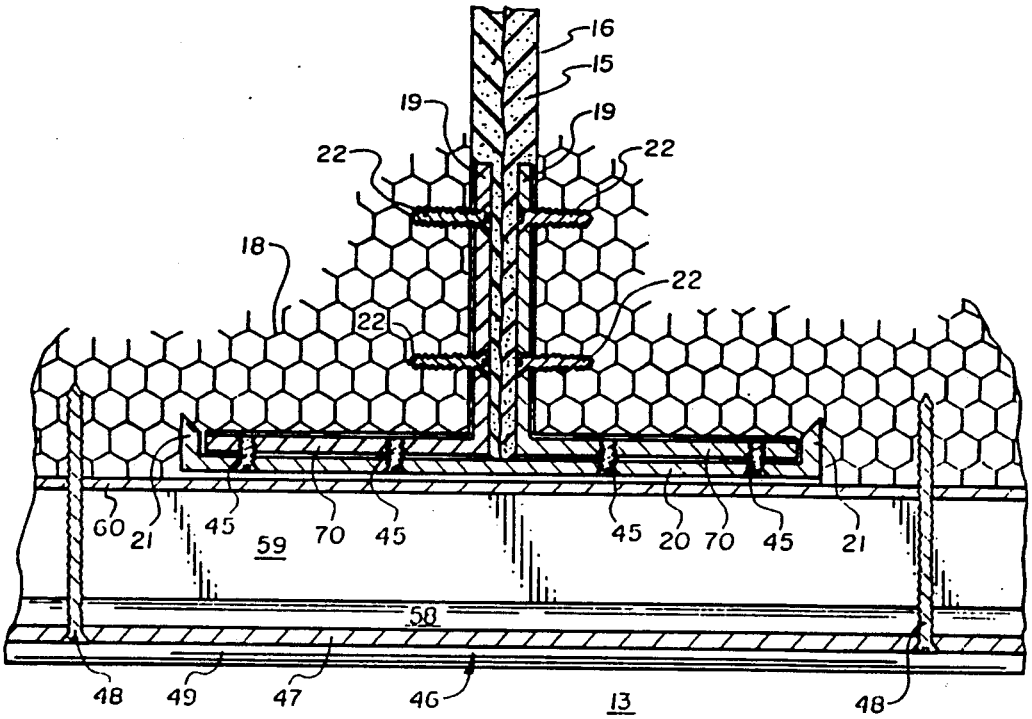
FIG. 6 is a cut away view of the trussed opening as shown in VI of FIG. 1.

FIG. 6 shows a cut-away view of a portion of two panels 51 which have been modified to form equipment opening 13. Panels 51 are brought in position by means of L-shaped braces 19 and retainer clip 20. To accomplish the placement of the L-shaped braces 19, a portion of the gasket 15 is cut away and the L-shaped brace is placed in the channel 16. The brace is securely fastened into the panel 51 by means of screws 22 which pass through the brace 19, the skin material 28 and into the core material 18. The L-shaped brace 19 is oriented in channel 16 such that the bottom leg 70 of the brace 19 lies adjacent the surface which has been formed in fabricating the opening 13. Retainer clip 20 is then placed over the bottom leg 70 of the L-shaped brace 19 and the bottom leg 70 of the adjacent L-shaped brace 19, within sections 21 of the retainer clip 20 passing over the distal ends of the leg portions 70 so as to hold the adjacent panel members 51 in close abutting relationship. The retainer 20 is then securely fastened to the leg portions 70 by means of screws 45. The L-shaped braces 19 along with retainer clip 20 function to truss the two adjacent panels 51 across the opening 13. This prevents any rotational movement applied to either of the panels 51 from causing relative displacement of the two sections of the panels 51.

Figure 7:
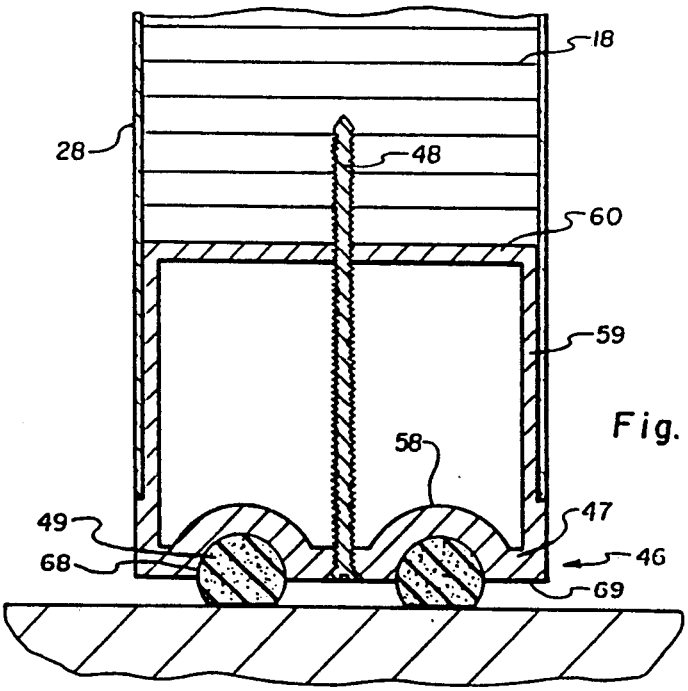
FIG. 7 is a cross-sectional view of the bulkhead taken along line 7—7 of FIG. 1.

As best seen in FIG. 6, bulkhead 46 is placed over the retainer clip 20 and along the entire top surface of the opening 13. The bulkhead 46 comprises a frame 47 having extension members 59 and cross support member 60. As best seen in FIG. 7, screw 48 is used to attach bulkhead 46 to the panel 50 by passing through the center of the bottom surface of the frame 47 and through cross support member 60 into the core 18. Semi-circular openings 68 are formed in the bottom surface 69 of bulkhead 46 and function to retain elastomeric rope 49 in place therein. Elastomeric rope 49 seals against the top surface of the equipment which passes through the opening 13. Other bulkhead sections may be used to seal the side and bottom surfaces of the equipment against the side and bottom surfaces of opening 13.

Figure 10:
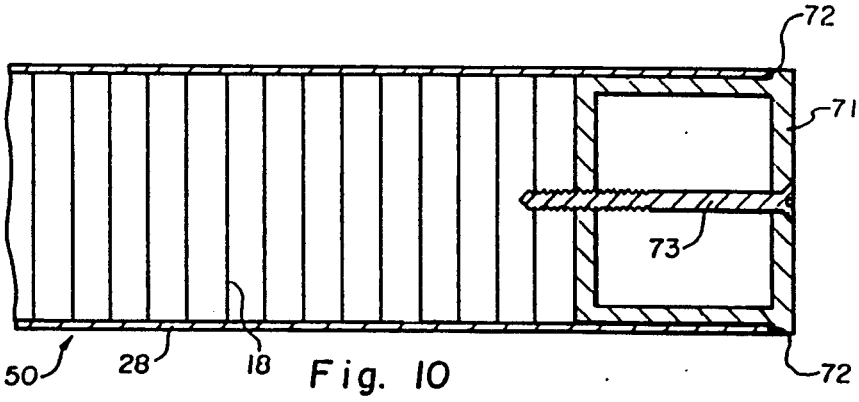
FIG. 10 is a cross-sectional view of an opening frame plug taken along line 10—10 of FIG. 1.

When it is desired to create an opening such as window opening 82 as seen in FIG. 1, the panel 50 or 51 is cut to the desired size and, if necessary adjacent panels making up portions of the window opening are trussed as explained above. Then, instead of lining the edges with bulkhead 46, the edges of the newly formed opening 82 are aligned with framing plugs 71. As best can be seen in FIG. 10, to insert framing plug 71 it is first necessary to remove a portion of the core material 18. Then the framing plug 71 is inserted until lip portion 72 meets metal skin 28. The plug 71 can be either fastened by adhesive or by a screw 73.

Figure 8:
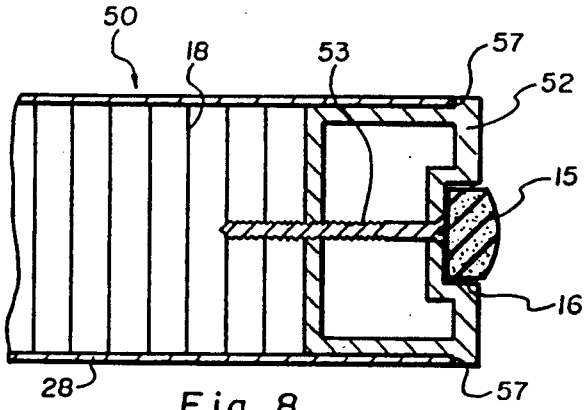
FIG. 8 and 9 are cross-sections of a wall panel showing alternative embodiments thereof.

FIG. 8 shows an alternative embodiment of the wall panel 50 in which the side surface 14, as shown in FIG. 2, is replaced with an end plug 52. The end plug 52 can be held in place by means of adhesive, or by means of screw 53. Plug 52 defines channel 16 in which gasket 15 is placed substantially in the same manner as previously described. Plug 52 is advantageously used when it is desired to modify the width of a standard wall panel 50. The wall panel 50 is cut to the desired width and the core 18 is removed from the cut side to a depth sufficient to allow plug 15 to be inserted therein. After plug 15 is securely fastened in the wall panel 50, it functions substantially in an identical manner to the original side surface 14 and gasket 15.

Figure 9:
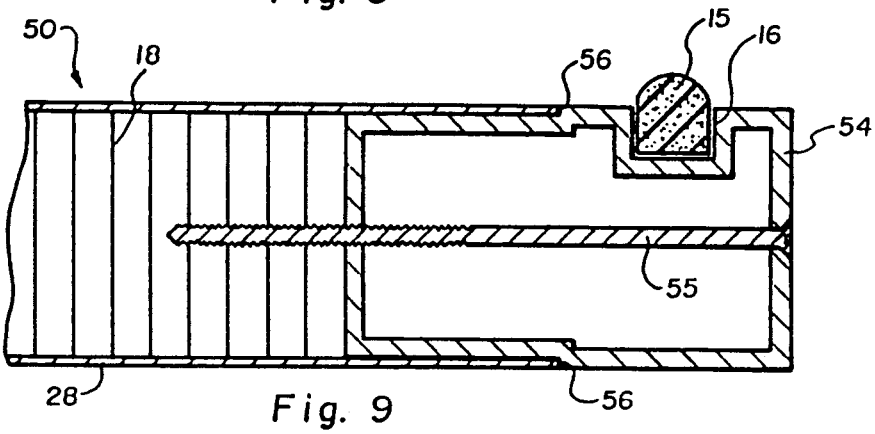

FIG. 9 shows another embodiment of plug 52 which includes a plug 54 having channel 16 placed therein such that gasket 15 is located on the front surface of the panel instead of the side surface thereof. The plug 54 is inserted into wall 50 in the same manner as described for plug 52. With gasket 15 located on the front surface of panel 50, a panel placed directly adjacent thereto to create a corner in the wall system would then have its gasket 15 abut directly with the gasket 15 in plug 54.

Figure 11:
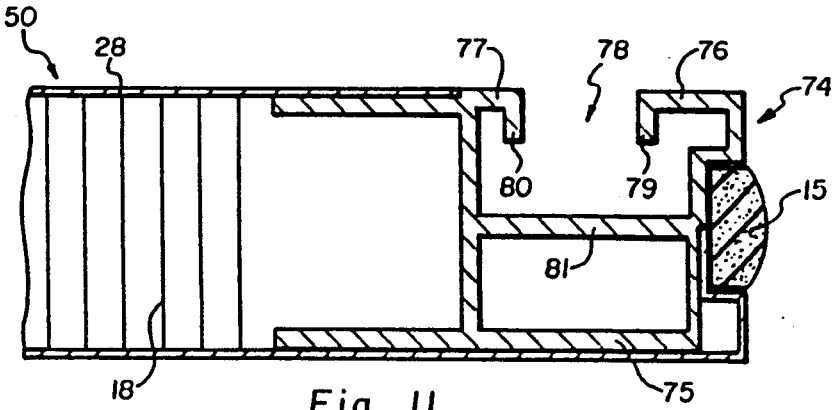
FIG. 11 is a cross-sectional view of a rack support assembly taken line 11—11 of FIG. 1.

FIG. 11 shows a cross sectional view of one side of panel 50 which has been modified to include a rack support assembly 74. The support assembly 74 is incorporated into, and becomes the end surface of the panel 50 in much the same manner as the above-described plug members 52, 54, and 71, and comprises a channel 16 with gasket 15 located therein. The rack support assembly 74 further includes an opening 78 which is located on the front surface of the panel 50 and extends the entire length thereof. The opening 78 is bordered by rack attachment arms 76 and 77 which contain attachment shoulders 79 and 80 respectively. Well known rack support members can be placed into opening 78 and securely fastened to attachment arms 76 and 77 and securely braced into position by rack support base 81 in a well known manner.

Plug 54, plug 52, plug 71 and rack support 74, along with bulkhead 46, may be made of an extruded aluminum, plastic, or other suitable material, and may be hollow as shown in the drawings or may be solid. Gaskets 15, 24, 39, 40 and 64 are made of any elastomeric material capable of sealing against airflow, and are preferably made of neoprene.

It is to be understood that the above described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

We claim:

1. A modular wall system for removable placement between a floor and a ceiling as part of a cleanroom construction comprising:

panel means having a top portion and a bottom portion, said bottom portion including a first fastening member and a generally U-shaped channel member having two leg members separated by a central member, said central member comprising a bottom surface which extends along substantially the entire length thereof, said bottom surface having means for attaching said first fastening member thereto, head means attachable to the ceiling for contacting said top portion of said panel means, elongate floor means comprising a second fastening member and a generally U-shaped channel portion having two leg portions separated by a central portion, said floor means being placeable on the floor for contacting said bottom portion of said panel means, said central portion comprising a support surface which extends along substantially the entire length thereof, said second fastening member being located on said support surface, whereby, when said panel means is positioned on said elongate floor means, said first fastening member can attach to said second fastening member while said bottom surface and said support surface remain in spaced-apart relationship;

further comprising a plurality of panel means placed in adjacent abutting relationship, each of said plurality of panel means comprising first and second side surfaces, and at least one of said first and second side surfaces having a compressible gasket means located thereon, whereby when said side surface of said panel means containing said gasket means is placed in abutting relationship with adjacent panel means, said gasket means contacts said adjacent panel means;

each of said first and second side surfaces of said panel means including an elongated channel formed therein, and each of said channels having a compressible gasket means located therein; and said gasket means located in the channel of said first side surface being formed with a thickness which exceeds the depth of said channel into which it is located, and is greater than the thickness of the gasket means located in the channel of said second side surface, the thickness of the gasket means located in the channel of said second side surface being less than the depth of the channel into which it is located.

2. A modular wall system according to claim 1 wherein a portion of said gasket means located in said channel of said first side surface extends outwardly from said first side surface and, when contacted by a second side surface of said adjacent panel means, which second side surface of said adjacent panel means is identical to said second side surface of said panel means, the portion of said gasket means which extends outwardly of said first side surface of said panel means will extend at least partially into said channel located in said second side surface of said adjacent panel means in a sealing manner.

3. A modular wall system for removable placement between a floor and a ceiling as part of a cleanroom construction comprising:

a plurality of panel means placed in adjacent abutting relationship, each of said panel means having a top portion and a bottom portion, and opposing first and second side surfaces, wherein each of said first and second side surfaces of said panel means includes an elongated channel formed therein, and each of said channels has a compressible gasket means located therein, said gasket means located in the channel of said first side surface is formed with a thickness which exceeds the depth of said channel into which it is located, and is greater than the thickness of the gasket means located in the channel of said second side surface, the thickness of the gasket means located in the channel of said second side surface being less than the depth of the channel into which it is located, head means attachable to the ceiling for contacting said top portion of said panel means, and elongate floor means placeable on the floor for contacting said bottom portion of said panel means.

* * * * *